US012595992B1

(12) United States Patent
Zemore et al.

(10) Patent No.: US 12,595,992 B1
(45) Date of Patent: Apr. 7, 2026

(54) ARROWHEAD

(71) Applicants: Jason P. Zemore, Burton, MI (US); Spencer D. Brackins, Burton, MI (US)

(72) Inventors: Jason P. Zemore, Burton, MI (US); Spencer D. Brackins, Burton, MI (US)

( * ) Notice: Subject to any disclaimer, the term of this patent is extended or adjusted under 35 U.S.C. 154(b) by 177 days.

(21) Appl. No.: 18/229,435

(22) Filed: Aug. 2, 2023

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/582, 583
See application file for complete search history.

(56) References Cited

U.S. PATENT DOCUMENTS 2,873,973 A * 2/1959 Hauch ..... F42B 6/08 473/583
3,419,273 A * 12/1968 Rudzinski ..... F42B 6/08 473/583
3,741,542 A * 6/1973 Karbo ..... F42B 6/08 473/584
3,887,186 A * 6/1975 Matlock, Jr. ..... F42B 6/08 473/584
3,995,860 A * 12/1976 Manspeaker ..... F42B 6/08 30/332
4,452,459 A * 6/1984 Doonan ..... F42B 6/08 473/584
4,505,482 A * 3/1985 Martin, Sr. ..... F42B 6/08 D22/115
4,534,568 A * 8/1985 Tone ..... F42B 6/04 403/164
4,928,969 A * 5/1990 Nagatori ..... F42B 6/08 473/584
4,974,859 A * 12/1990 Briesemeister ..... F42B 6/08 473/584
6,077,179 A * 6/2000 Liechty, II ..... F42B 6/08 473/582
6,319,161 B1 * 11/2001 Martinez ..... F42B 6/08 473/583
6,743,128 B2 * 6/2004 Liechty, II ..... F42B 6/08 30/357
6,863,630 B1 * 3/2005 Watkins ..... F42B 6/08 473/583
7,037,222 B2 * 5/2006 Mizek ..... F42B 6/08 473/583
7,037,223 B2 * 5/2006 Kuhn ..... F42B 6/08 473/583
7,160,217 B2 * 1/2007 Sohm ..... F42B 6/08 473/583
8,100,788 B2 * 1/2012 Sanford ..... F42B 6/08 473/582
8,147,362 B2 * 4/2012 Muntanion ..... F42B 6/08 473/583

(Continued)

*Primary Examiner* — Alexander R Niconovich
(74) *Attorney, Agent, or Firm* — Laurence L. Begin

(57) ABSTRACT

An arrowhead, in accordance with the present invention, includes an apex, and a first pair of blades fixed about an axis of the arrowhead, each of the preferably coplanar blades containing an edge defining a single-bevel edge that transitions to a double-bevel edge along the periphery of the arrowhead. The arrowhead may further contain a smaller second pair of blades fixed about the axis, each of the second pair of blades spaced apart from a primary blade, each of the second pair of blades extending along and fixed to the arrowhead along the axis.

20 Claims, 5 Drawing Sheets

(56) References Cited

U.S. PATENT DOCUMENTS

| | | | | |
|---|---|---|---|---|
| 8,313,398 | B2 * | 11/2012 | Baker | F42B 6/08 473/583 |
| 8,496,549 | B2 * | 7/2013 | Couture | F42B 6/08 473/583 |
| 8,771,113 | B2 * | 7/2014 | Patton | F42B 6/08 473/583 |
| 9,062,944 | B1 * | 6/2015 | Dupuis | F42B 6/08 |
| 9,157,710 | B1 * | 10/2015 | Huntsman | F42B 6/08 |
| 10,054,407 | B2 * | 8/2018 | Moore | F42B 6/08 |
| 10,054,409 | B2 * | 8/2018 | Vanderheyden | F42B 6/08 |
| 10,866,074 | B1 * | 12/2020 | Morton | F42B 6/08 |
| 11,236,976 | B2 * | 2/2022 | Burdette | F42B 6/08 |
| 12,092,443 | B1 * | 9/2024 | Anderson | F42B 6/08 |
| 12,104,888 | B2 * | 10/2024 | Fisher | F42B 6/08 |
| 12,140,409 | B2 * | 11/2024 | Barnette | F42B 6/08 |
| 2009/0233742 | A1 * | 9/2009 | Sanford | F42B 6/08 29/428 |
| 2021/0270584 | A1 * | 9/2021 | Jonsson | F42B 6/08 |
| 2023/0251069 | A1 * | 8/2023 | Fisher | F42B 6/08 473/583 |
| 2023/0258439 | A1 * | 8/2023 | Brodie | F42B 6/08 473/583 |

* cited by examiner

ARROWHEAD

CROSS-REFERENCE TO RELATED APPLICATIONS

Technical Field

The present invention relates to a novel arrowhead designed to cut and penetrate while still maintaining a true bearing as launched within an arrow.

BACKGROUND OF THE INVENTION

Arrowheads have long been developed since ancient days of humanity. However, there is always a challenge to improve on the state of the art, particularly with regard to the efficiency and accuracy of an arrow incorporating the desired arrowhead. Without the maximum penetration and efficiency of the arrow containing the arrowhead, a hunter may not realize the full potential of the hunt, or the harvest at the end of the hunt. In particular, certain concerns include the propensity for the arrowhead or tip to bend upon impact. Yet further, during hunting, it is desired that the bone and/or flesh of the animal split upon impact, thereby maximizing the likelihood of a take down with the shot, and also maximizing the penetration of the arrow into the prey. Yet further, during hunting, features that would promote a blood trail upon impact of the animal would also provide an advance in the art.

SUMMARY OF THE INVENTION

The above concerns are reconciled by a novel arrowhead or tip that is designed to maximize the efficacy of the arrowhead as it penetrates an animal. In one aspect, an arrowhead in accordance with the present invention includes an apex, and a first pair of blades fixed about an axis of the arrowhead, each of the preferably coplanar blades containing an edge defining a single-bevel edge that transitions to a double-bevel edge along the periphery of the arrowhead. The arrowhead may further contain a second pair of blades fixed about the axis, each of the second pair of blades spaced apart from a primary blade, each of the second pair of blades extending along and fixed to the arrowhead along the axis. The second pair of blades of the arrowhead may be spaced about 45 to 90 degrees from one of a first pair of blades, and more preferably may be spaced 90 degrees from one of the first pair of blades.

Stated another way, the present invention includes an arrowhead containing an apex; a first pair of blades fixed about an axis of the arrowhead; a pair of opposed single-bevel edges equiangularly and downwardly extending from the apex; a first terminus point and a second terminus point at each respective lower end of the single-bevel edges; and a pair of opposed double-bevel edges, each equiangularly and downwardly extending from the first and second terminus points, respectively. Accordingly, a single-bevel edge transitioning into a double-bevel edge along each side or first blade and along the periphery of the arrowhead, is sequentially formed on each one of the first pair of blades. The arrowhead may further contain a second smaller or more concise pair of blades fixed about the axis, each of the second pair of blades spaced about 45 to 90 degrees from one of a first pair of blades, each of the second pair of blades extending along and fixed to the arrowhead along the axis.

BRIEF DESCRIPTION OF THE DRAWINGS

Presently preferred embodiments of the invention are disclosed in the following description and in the accompanying drawings, wherein.

DETAILED DESCRIPTION OF THE PREFERRED EMBODIMENTS

Non-Limiting Definitions

Figure 1:
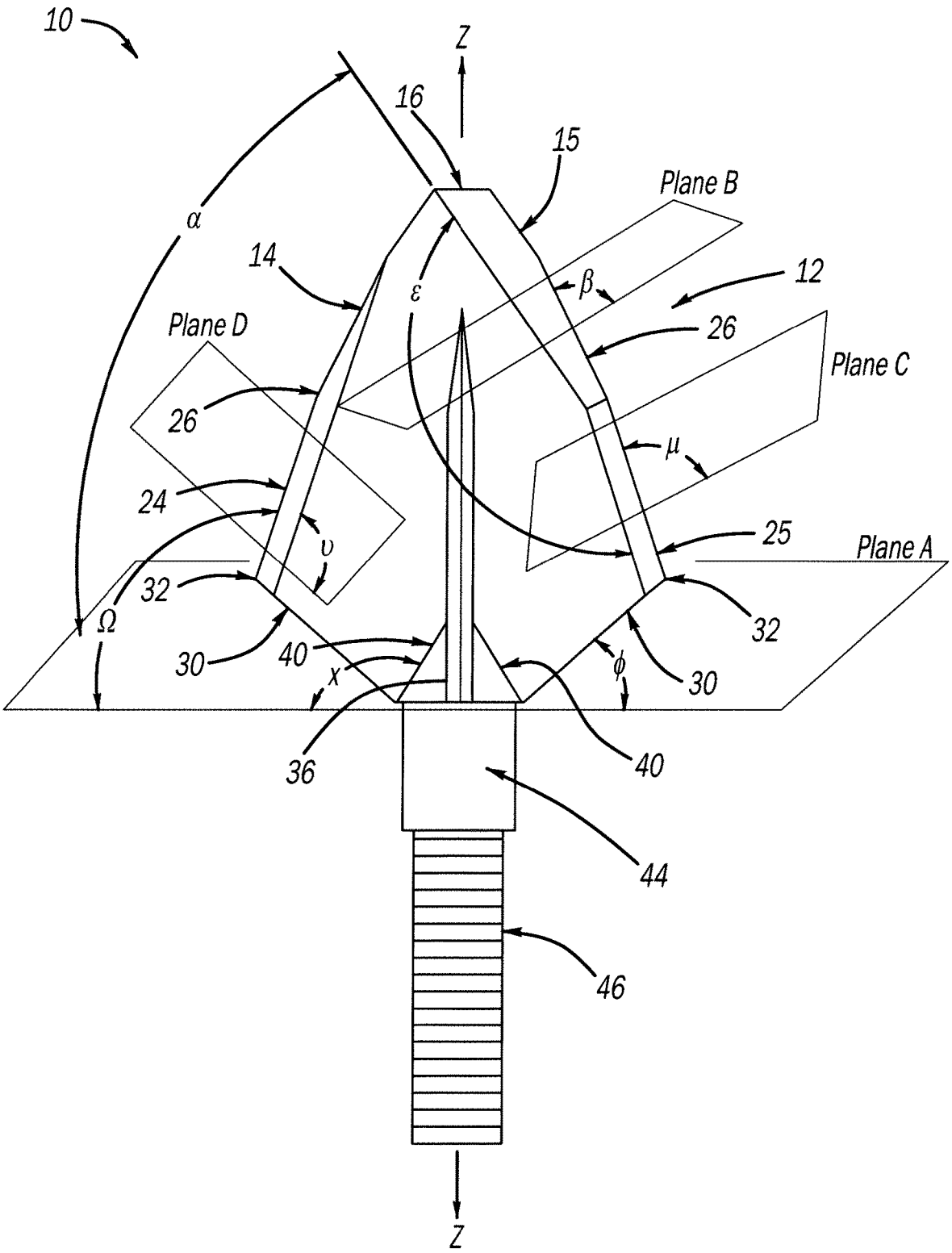
FIG. 1 illustrates a first view of an arrowhead emphasizing a pair of primary blades of the tip.

The terms "a", "an", and "the" are intended to include the plural forms as well unless the context clearly indicates otherwise.

The terms "about" or "approximately" applies to all numeric values, whether or not explicitly indicated. These terms generally refer to a range of numbers that one of skill in the art would consider equivalent to the recited values (i.e., having the same function or result). In many instances, these terms may include numbers that are rounded to the nearest significant figure.

The term "another", as may be used herein, is defined as at least a second or more.

The phrase "associated with", as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

The phrases "at least one of <A>, <B>, . . . and <N>" or "at least one of <A>, <B>, . . . and <N>, or combinations thereof" or "<A>, <B>, . . . and <N>" are defined by the Applicant in the broadest sense, superseding any other implied definitions hereinbefore or hereinafter unless expressly asserted by the Applicant to the contrary, to mean one or more elements selected from the group comprising A, B, . . . and N, that is to say, any combination of one or more of the elements A, B, . . . or N including any one element alone or in combination with one or more of the other elements which may also include, in combination, additional elements not listed.

The term "communicate" as well as derivatives thereof, encompasses both direct and indirect communication.

The terms "comprises" and/or "comprising", when used in this specification, specify the presence of stated features, steps, operations, elements, and/or components but do not preclude the presence or addition of one or more other features, integers, steps, operations, elements, components, and/or groups thereof.

The term "coupled", is defined as "connected", although not necessarily directly and not necessarily mechanically.

The terms "including" and "having", as used herein, are defined as comprising (i.e., open language).

The term "or" is intended to mean an inclusive "or" rather than an exclusive "or". That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

The terms "substantial" and "substantially" means, when comparing various parts to one another, that the parts being compared are equal to or are so close enough in dimension that one of skill in the art would consider the same. Substantial and substantially, as used herein, are not limited to a single dimension, and specifically include a range of values for those parts being compared. The range of values, both above and below (e.g., "+/−" or greater/lesser or larger/smaller), includes a variance that one skilled in the art would know to be a reasonable tolerance for the parts mentioned.

Note that not all of the activities described above in the general description or the examples are required, that a portion of a specific activity may not be required, and that one or more further activities can be performed in addition to those described. Still further, the order in which activities are listed is not necessarily the order in which they are performed.

DETAILED DESCRIPTION OF THE INVENTION

Figure 2:
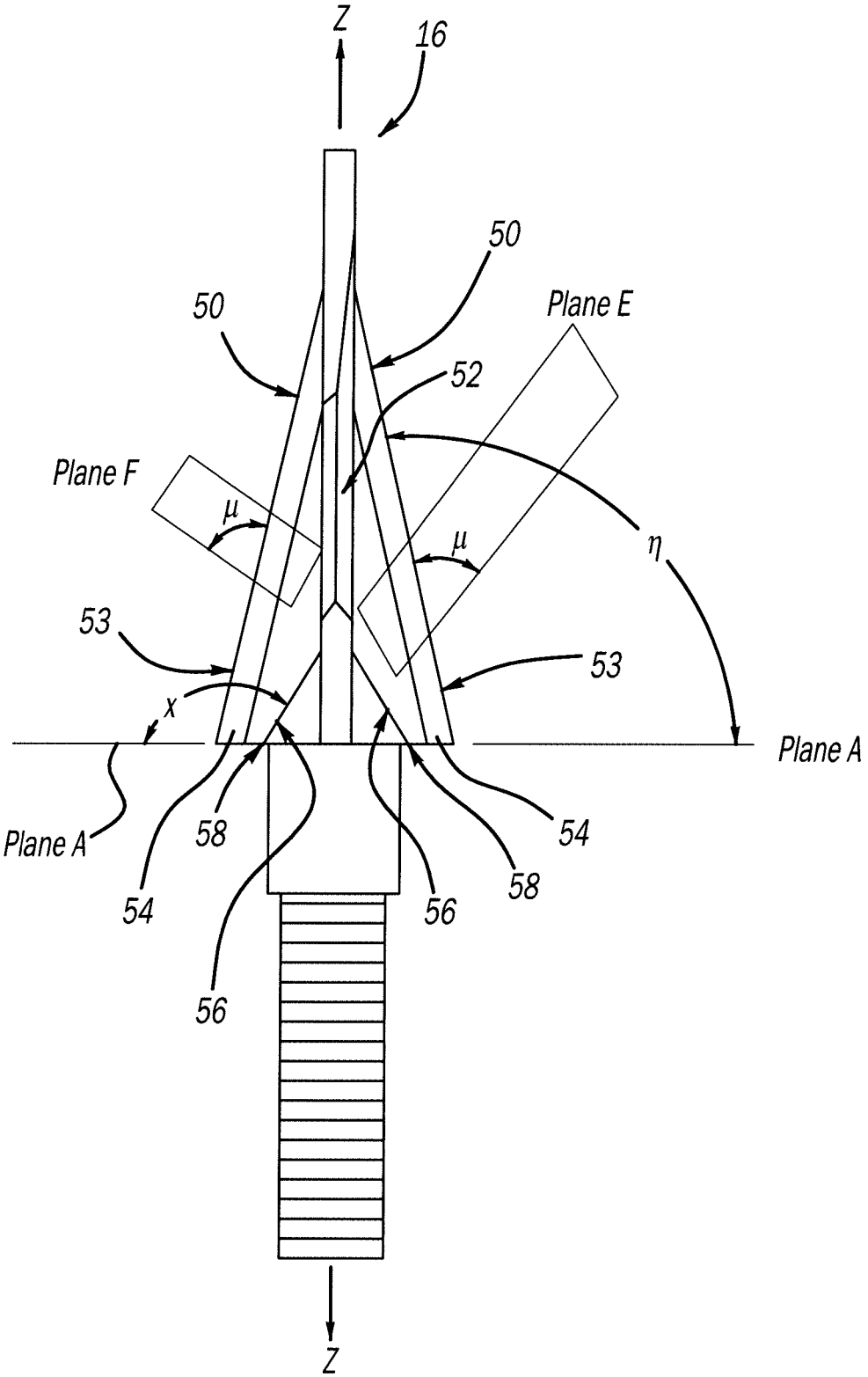
FIG. 2 illustrates a second view of the arrowhead of FIG. 1 emphasizing a pair of secondary blades of the tip.
Figure 3:
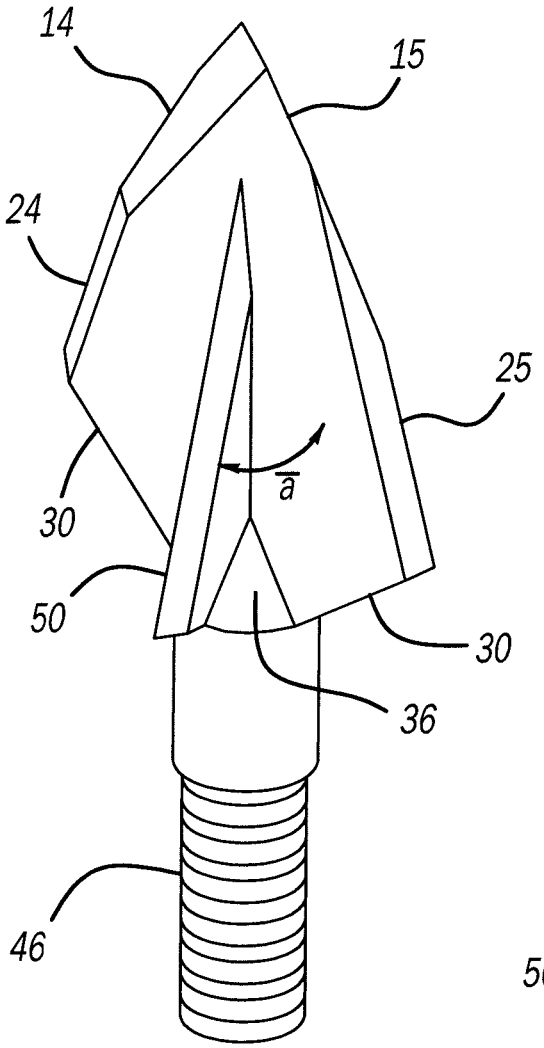
FIG. 3 illustrates a perspective view of the arrowhead taken from an upper vantage point.
Figure 4:
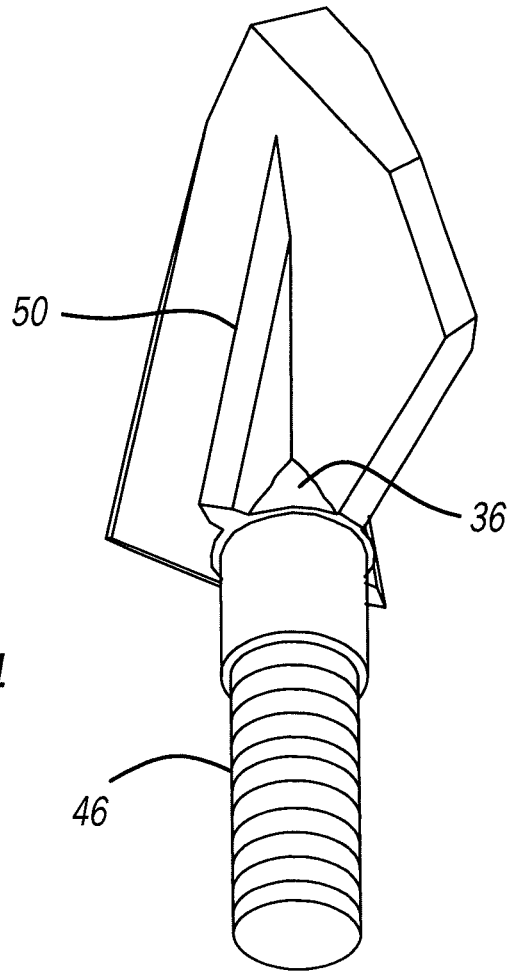
FIG. 4 illustrates a perspective view of the arrowhead taken from a lower vantage point.
Figure 5:
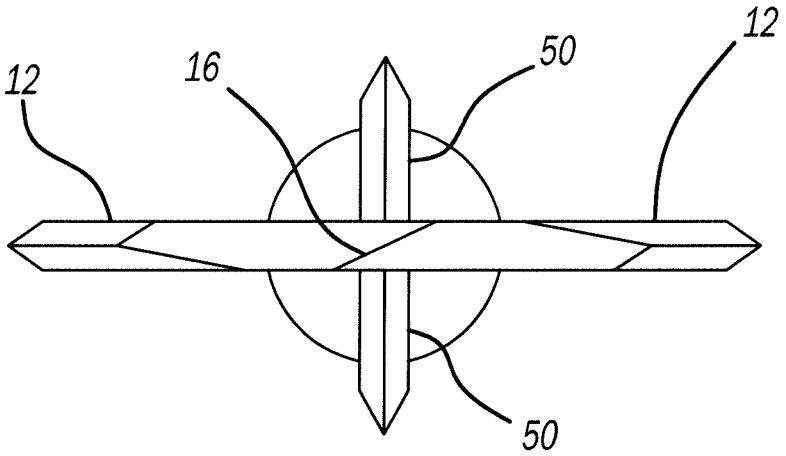
FIG. 5 illustrates an upper view of the arrowhead.
Figure 6:
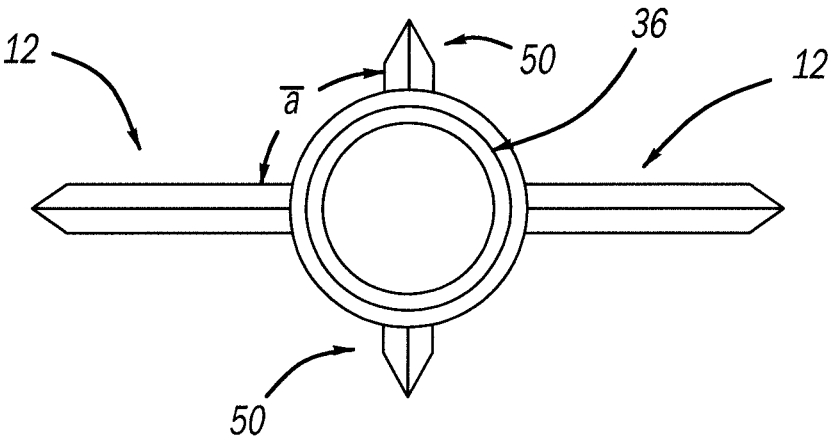
FIG. 6 illustrates a bottom view of the arrowhead.
Figure 7:
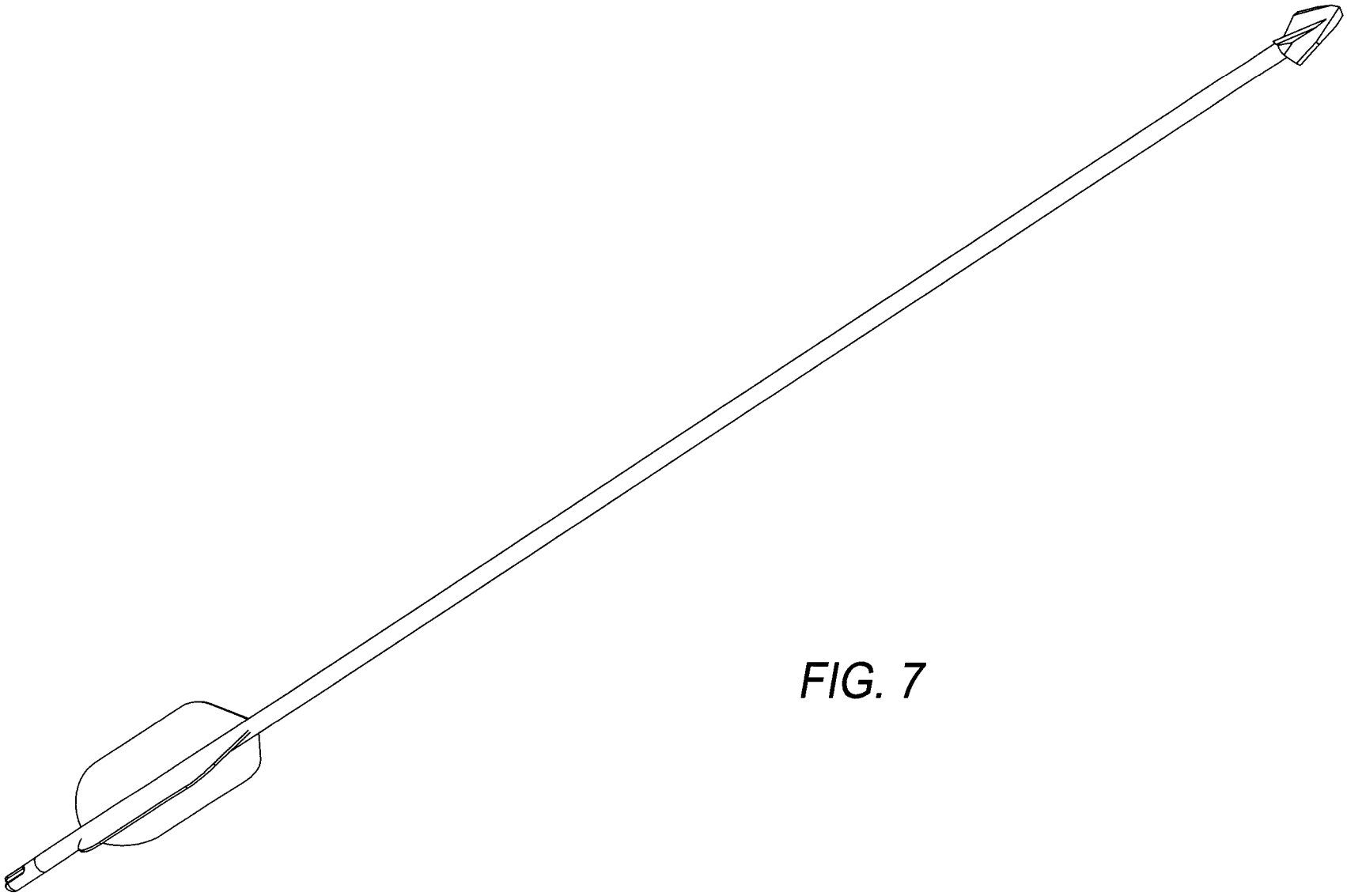
FIG. 7 illustrates an arrow incorporating an arrowhead of the present invention.

In accordance with the present invention, and referring to FIGS. 1 and 2, an arrowhead or tip 10 contains a first pair of primary blades 12. The arrowhead or tip 10 is relatively broad as compared to the width of typical arrowheads, thereby imparting an enhanced strength of the tip 10, to prevent bending. Each of a first pair of single-beveled edges 14, 15 angularly and outwardly extend from an apex 16 at an upper end 18 of the arrowhead 10, whereby each single-beveled edge 14, 15 with reference to the other edge 14 or 15, runs in an opposite direction along a respective opposite upper ridge of each primary blade 12. As shown in the drawings, in one embodiment, each of the pair of single-beveled edges 14, 15 angularly extend from the apex 16 at an angle of about 55 degrees, as measured from a plane A that horizontally and tangentially extends across a bottom portion 22 of the arrowhead 10. More generally, the single-beveled edges 14 may each angularly extend as measured from a horizontal plane A, thereby defining an acute angle $\alpha$ extending between 50 to 60 degrees from the plane A, and more preferably defining an angle of 55 (or 125) degrees as measured from the plane A. As measured from planes B and C, each plane respectively orthogonally intersecting each of the single-bevel edges 14, 15, each of the single-bevel edges 14, 15 are preferably cut at a beveled angle $\beta$ of 30 degrees, and more generally at a beveled angle $\beta$ of 25 to 35 degrees. It will be appreciated that the bevel may be leftward or rightward in its orientation or cut direction.

Again, with reference to FIGS. 1 and 2, each of a second pair of double-beveled edges 24, 25 angularly and outwardly extend from a pair of first terminal points 26 at lower ends opposite the apex 16 of each single-beveled edges 14, 15, whereby each double-beveled edge 24, 25 runs downwardly from the first terminal point 26 along a side ridge of a respective primary blade 12. As shown in the drawings, in one embodiment, each of the pair of double-beveled edges 24, 25 angularly extend from the terminal points 26 at an angle $\Omega$ of about 72 degrees as measured from a plane A that horizontally and tangentially extends through a bottom portion 22 of the arrowhead 10. More generally, each of the double-beveled edges 24, 25 may angularly extend as measured from a horizontal plane A, thereby defining an acute angle $\Omega$ extending between 65 to 80 degrees from the plane A, and more preferably defining an angle of 72 degrees as measured from the plane A. Yet further, the angle $\varepsilon$ defined at the transition from the first pair of single-bevel edges 14, 15 to the second pair of double edges 24, 25 may range from 165 to 175 degrees, and is more preferably 171.58 degrees. As measured from planes C and D, each plane respectively orthogonally intersecting a corresponding one of the double-bevel edges 24, 25, each of the double-bevel edges 24, 25 are preferably cut at a beveled angle $\mu$ of 30 degrees, and more generally at an angle $\mu$ of 25 to 35 degrees.

Again, with reference to FIGS. 1-2, each edge of a third pair of edges 30 angularly and inwardly extend from a respective second terminal point 32 at the bottom end of each double-beveled edge 24, 25 toward an axis Z extending through the apex 16 and through a shaft end 34, whereby each third edge 30 runs downwardly in toward the axis Z of the arrowhead 10, but intersects with the plane A. As shown in the drawings, in one embodiment, each of the pair of third edges 30 angularly and inwardly extend from the respective second terminal points 32 at an angle of about 41 degrees as measured from the plane A. More generally, each of the pair of third edges 30 may angularly extend as measured from a horizontal plane A, thereby defining an acute angle ø extending between 40 to 45 degrees from the plane A, and more preferably defining an angle ø of 41 degrees as measured from the plane A.

Again, with reference to the embodiment shown in FIGS. 1 and 2, each of a pair of fourth edges 40 extends upwardly and inwardly from a third pair of terminal end points 42 of the third edges 30, located adjacent to plane A, towards the axis Z. Fourth edges 40 thereby define and surround a cone-shaped center spine, which distributes the force on the arrowhead equally about the circumference of the arrow. A conical base 36 is coupled to the pair of fourth edges 40 whereby the fourth edges define an angle x of 120 degrees, and more generally an angle x of 115 to 125 degrees, as measured from the plane A. In the same way, the conical surface or base 36, that functions as a base for fixing the fourth edges 40 about the axis Z, also defines an angle x of 120 degrees as measured from the plane A. As with the other cuts, it will be appreciated that the angle x defined between the fourth edges 40 and the plane A may also be within a range such as 115 to 125 degrees, for example.

A coupler 44 is coaxially aligned and vertically juxtaposed and fixed to the conical base 36, for strengthening the connection of the arrowhead 10 to a shaft of an arrow. A threaded connector 46 is coaxially fixed to the coupler 44, for threadedly coupling the arrowhead to a shaft of an associated arrow.

In yet another aspect of the invention, each of a second pair of blades or bleeders 50 are both preferably orthogonally oriented to the primary blades 12. More generally, each of the second pair of blades 50 may be spaced at an angle ã of 45 to 90 degrees from the nearest primary blade 12. The second pair of blades 50 may be machined or otherwise metal-formed into the arrowhead 10. In a preferred embodiment, the second pair of blades or bleeders 50 may be sized to be about one-eighth to one-fourth the size in area of the primary blades 12, and, may extend from the bottom of the arrowhead 10 at plane A to a point defined between the middle portion 52 and the apex 16. The bleeder may be shaped as a right-triangular double-beveled blade, wherein the bleeder base 54 is adjacent to plane A, and its apex is fixed along a side of a primary blade 12. A double bevel edged hypotenuse 53 of each bleeder 50 may define an angle η of 103 degrees as measured from the plane A. More generally, the bleeder hypotenuse 53 may define an angle η of 95-110 degrees as measured from the plane A. As measured from planes E and F, each plane respectively orthogonally intersecting a corresponding one of the double-bevel edges 24, 25, each of the double-bevel edges 24, 25 are preferably cut at a beveled angle μ of 30 degrees, and more generally at an angle μ of 25 to 35 degrees.

As with the primary blades 12, the second pair of blades 50 are also coupled to the conical base 36. Each of a fifth pair of edges 56 extends upwardly and inwardly from a fourth terminal end point 58 of the bleeder base 54, towards the axis Z. The conical base 36 is coupled to the pair of fifth edges 56 whereby the fifth edges define an angle of 120 degrees as measured from the plane A. In the same way, the conical surface or base 36, that functions as a base for fixing the fifth edges 50 about the axis Z, also defines an angle x of 120 degrees as measured from the plane A. As with the other cuts, it will be appreciated that the angle x defined between the fifth edges 56 and the plane A may also be within a range such as 115 to 125 degrees, for example.

It is believed that the machined-in bleeders 50 open the wound channel up wider and cut anything in their path to cause more damage and prevent the channel from closing, thereby helping to promote a blood trail. Normal blood flow is disrupted, and hemorrhaging of different directions thereby enhances the opening and prevention of closure of the wound. The bleeders 50 also mitigate or prevent the bending of the primary blades 12 from bending in the bleeder 50 direction by increasing structural integrity throughout the arrowhead 10. It is believed that the presence of the bleeders 50 also add wings that create a tighter wind bubble causing more stabilized rotation similar to a rifled barrel.

In accordance with one aspect of the present invention, the single-beveled edges 14, 15 will first enter a target, followed by the double-beveled edges 24, 25. The single-bevel feature provides a bone-crushing torque and rotation through the initial impact. Yet further, the single-beveled edges 14, 15 continue to rotate after impact, thereby causing additional damage and opening a larger wound channel. In further accordance with the present invention, the double-beveled edges 24, 25 when following the single-beveled edges 14, 15 through the initial wound, ease the resistance and tissue drag, and facilitates ease of continued rotation of the single-bevel edges 14, 15 without wasting energy. Ultimately, the unique combination and sequence of the single-bevel edges 14, 15 followed by the double-bevel edges 24, 25 results in a significant increase in hemorrhaging and blood loss, thereby contributing to the take-down of the target.

Further advantages may include: better flight at close and long ranges; more penetration believed to be because of the combined single and double bevel edges and transition; machined-in bleeders enhance the strength of the broadhead 10 while also optimizing the packaging and compactness of the arrowhead 10. The arrowhead 10 is made from steel, metals, alloys, or similarly strong materials such as tough and hard polymers, for example. Tool steel, for example, may provide a Rockwell hardness of 58. The present arrowhead 10 is believed to be stronger than any other currently available arrowhead, even withstanding being shot into brick.

A preferred arrowhead may be manufactured by beginning with a solid piece of S7 tool steel, or any other suitable substrate. The piece may then be machined in a Swiss lathe. In a first step, the threads 46 and ferrule 44 are machined. Then, the main blades 12 and the bleed blades 50 are formed in the lathe, as described herein. Finally, the edges are beveled as described herein. Once the machining is complete, the arrowhead 10 may be heat treated to a hardness of about 58 Rockwell. Finally, the arrowhead may be subjected to a black oxide process to protect the arrowhead from rusting. It will be appreciated that so long as the dimensions and geometry of the arrowhead remains consistent as described herein, certain hardness, rust protection, and other steps may optionally be completed.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any appended claims or claim elements unless the exact words "means for" or "step for" are explicitly used in the particular claim, followed by a participle phrase identifying a function.

Benefits, other advantages, and solution to problems have been described above with regard to specific embodiments. However, the benefits, advantages, solutions to problems, and any feature(s) that can cause any benefit, advantage, or solution to occur or become more pronounced are not to be constructed as a critical, required, sacrosanct, or an essential feature of any or all of the claims.

After reading the disclosure, skilled artisans will appreciate that certain features are, for clarity, described herein in the context of separate embodiments, and can also be provided in combination in a single embodiment. Conversely, various features that are, for brevity, described in the context of a single embodiment, can also be provided separately or in any sub . . . combination. Further, references to values stated in ranges include each and every value with that range.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. An arrowhead comprising:

an apex;

a first pair of blades fixed about an axis of said arrowhead;

a pair of opposed single-bevel edges equiangularly and downwardly extending from said apex;

a first terminus point and a second terminus point at each respective lower end of the single-bevel edges; and a pair of opposed double-bevel edges, each equiangularly and downwardly extending from said first and second terminus points, respectively, wherein each of said single-bevel edges and said double-bevel edges is formed on one of said first pair of blades.

2. The arrowhead of claim 1 wherein each of said double-bevel edges are angled from a first terminal point of the single-bevel edges in a range from 50 to 60 degrees as measured from a first plane tangentially oriented with a base of said arrowhead, said axis orthogonally intersecting said first plane.

3. The arrowhead of claim 2 wherein said double-bevel edges are angled from a first terminal point of the single-bevel edges at 55 degrees, as measured from said first plane.

4. The arrowhead of claim 1 wherein said single-bevel edges are cut at an angle ranging from 25 to 35 degrees, and, said double-bevel edges are cut at an angle ranging from 25 to 35 degrees, each angle of each single-bevel edge measured from a respective plane orthogonally intersecting said single-bevel edge, and, each angle of each double-bevel edge measured from a respective plane orthogonally intersecting said double-bevel edge.

5. The arrowhead of claim 4 wherein said single-bevel edges are cut at an angle of about 30 degrees, and, said double-bevel edges are cut at an angle of about 30 degrees.

6. The arrowhead of claim 1 further comprising a second pair of blades fixed about said axis, each of said second pair of blades spaced about 45 to 90 degrees from at least one of a first pair of blades, each of said second pair of blades extending along and fixed to the arrowhead along said axis.

7. The arrowhead of claim 6 wherein each of said second pair of blades is about one-eighth to one-half of an area of one of said primary blades.

8. The arrowhead of claim 6 wherein each of said second pair of blades is a right triangle comprising a base, a height, and a hypotenuse.

9. The arrowhead of claim 8 wherein said hypotenuse extends from a first plane to said axis, at an angle ranging from 95 to 110 degrees as measured from said first plane.

10. The arrowhead of claim 9 wherein said hypotenuse extends from said first plane to said axis at an angle of 103 degrees.

11. The arrowhead of claim 6 wherein said second pair of blades are substantially coplanar.

12. The arrowhead of claim 6 wherein each of said second pair of blades is fixed to the arrowhead about 90 degrees from a primary blade.

13. The arrowhead of claim 1 wherein said first pair of blades are substantially coplanar.

14. An arrowhead comprising:

an apex;

a first pair of coplanar blades fixed about an axis of said arrowhead;

a second pair of blades fixed about said axis, each of said second pair of blades spaced apart from a primary blade, each of said second pair of blades extending along and fixed to the arrowhead along said axis;

a pair of opposed single-bevel edges equiangularly and downwardly extending from said apex;

a first terminus point and a second terminus point at each respective lower end of the single-bevel edges; and a pair of opposed double-bevel edges, each equiangularly and downwardly extending from said first and second terminus points, respectively, wherein each of said single-bevel edges and said double-bevel edges is formed on one of said coplanar blades.

15. The arrowhead of claim 14 wherein each of said second pair of blades is spaced about 45 to 90 degrees from a primary blade.

16. The arrowhead of claim 14 wherein each of said second pair of blades is spaced 90 degrees from one of the first pair of blades.

17. An arrowhead comprising:

an apex; and a first pair of substantially coplanar blades fixed about an axis of said arrowhead, each of said first pair of blades containing a periphery defining a single-bevel edge that transitions to a double-bevel edge along the periphery of the arrowhead.

18. The arrowhead of claim 17 further comprising a second pair of blades fixed about said axis, each of said second pair of blades spaced apart from at least one of the first pair of blades, each of said second pair of blades extending along and fixed to the arrowhead along said axis.

19. The arrowhead of claim 18 wherein each of said second pair of blades is spaced about 45 to 90 degrees from at least one of a first pair of blades.

20. An arrow containing the arrowhead of claim 17.

* * * * *